United States Patent [19]

Kimura

[11] 4,040,206

[45] Aug. 9, 1977

[54] BASE AND ROTATABLY MOUNTED DOLL WITH RELATIVELY MOVABLE PART

[75] Inventor: Osamu Kimura, Tokyo, Japan

[73] Assignee: Tomy Kogyo Co., Inc., Tokyo, Japan

[21] Appl. No.: 609,204

[22] Filed: Sept. 2, 1975

[30] Foreign Application Priority Data

Sept. 4, 1974 Japan ..... 49-106378[U]

[51] Int. Cl.[2] ..... A63H 13/02

[52] U.S. Cl. ..... 46/138

[58] Field of Search ..... 46/136, 138, 140

[56] References Cited

U.S. PATENT DOCUMENTS

| | | | |
|---|---|---|---|
| 1,685,358 | 9/1928 | Harcourt | 46/120 UX |
| 2,559,201 | 7/1951 | Schy et al. | 46/120 |
| 2,932,918 | 4/1960 | Pearson, Jr. | 46/138 X |

FOREIGN PATENT DOCUMENTS

| | | | |
|---|---|---|---|
| 494,609 | 7/1950 | Belgium | 46/120 |
| 173,266 | 12/1885 | France | 46/121 |
| 420,070 | 4/1947 | Italy | 46/138 |

*Primary Examiner*—F. Barry Shay
*Attorney, Agent, or Firm*—Edward D. O'Brian

[57] ABSTRACT

A doll which is at least partially articulated having a leg and a rod extending through said leg for use in transmitting motion to at least one articulated part of the doll can be mounted on a base through the use of cooperating parts on the base and the leg. Such cooperating parts hold the leg so that the doll can either be rotated about an axis or held in a fixed position. With the doll the rod is rotatably mounted in the leg and is connected by a coupling structure to a drive structure which is located on the base. An adjustment structure is provided on the base for controlling the operation of the cooperating parts so that the doll can either be rotated about an axis as indicated or can be held in a fixed position. In both of these positions the drive means can be utilized to rotate the rod. When the rod is rotated as the leg is held against rotation at least one articulated part of the doll is moved. When the rod is rotated as the leg is free to rotate the doll itself is rotated as a result of the motion transmitted through the rod.

9 Claims, 7 Drawing Figures

BASE AND ROTATABLY MOUNTED DOLL WITH RELATIVELY MOVABLE PART

BACKGROUND OF THE INVENTION

The invention set forth in this specification pertains to new and improved articulated doll structures which are used in combination with a base and a drive structure so that at least one part of the doll may be moved relative to other parts of the doll. Such dolls are particularly intended to be utilized in simulating the poses and movements of a ballerina, but can, of course, be employed for other purposes.

Articulated dolls are, of course, well known and many such dolls have been used for centuries. It is not considered that an understanding of the present invention requires a detailed consideration of such prior art dolls. Although articulated dolls have been constructed so that mechanical movement can be transmitted to a doll from a base through an appropriate rod or link the various known constructions of such dolls are not considered to make it possible for such dolls to be used to effectively simulate the poses and actions of the ballet.

This can be illustrated in a number of ways. It is known to cause movement within a doll on a stand through the use of a lever or link extending upwardly through a leg of the doll mounted on a platform. In structures such as this the lever or link is normally moved in a linear manner so as to transmit motion to the articulated parts of the doll by means of a crank type linkage arrangement. With this type of structure it is known to rotatably mount the platform on which the doll is supported. On occasion dolls have been constructed to utilize a rotatable shaft to transmit motion directly to the body of a doll so as to cause movement of articulated parts by mechanical action.

Unquestionably dolls constructed as briefly noted in the preceding are utilitarian. However, it is not considered that they can effectively be utilized to simulate the graceful movements employed by a ballet dancer such as a ballerina. It is not considered that such dolls are as effective as teaching aids as may be desired in that they do not tend to teach coordination by giving a child a cause and effect type of feedback reaction as they are used. Further, it is considered that in general such prior structures as are briefly indicated in the preceding tend to be of such a character that they are not desirable for commercial manufacture at this time.

SUMMARY OF THE INVENTION

A broad objective of this invention is to provide new and improved mechanically operated articulated doll structures. The invention is also intended to provide structures of this type which can be effectively utilized to simulate the movements and poses of a ballet dancer. The invention is also intended to provide dolls as described which are effective at developing coordination incomparatively young children. A further objective of the invention is to provide dolls as indicated which can be easily and conveniently manufactured at a comparatively nominal cost and which are capable of being utilized over a relatively prolonged period with a minimum of maintenance.

In accordance with this invention these objectives are achieved in the combination of a base, a doll which is at least partially articulated having a leg, this leg being supported on this base, and a rod extending from the base through the leg for use in transmitting motion to at least one articulated part of the doll by providing the improvement which comprises: the rod being rotatably mounted on the leg, cooperating mounting means on the base and on the leg for holding the leg so that the leg and the doll can either be rotated about an axis or can be held in a fixed position, adjustment means for controlling the operation of the mounting means so that the leg and the doll can either be rotated about the axis or can be held in a fixed position, drive means for rotating the rod located on the base and coupling means located on the base for connecting the drive means to the rod so that during the operation of the drive means the rod is rotated.

BRIEF DESCRIPTION OF THE DRAWINGS

The invention is best more fully explained with reference to the accompanying drawings in which.

Figure 1:
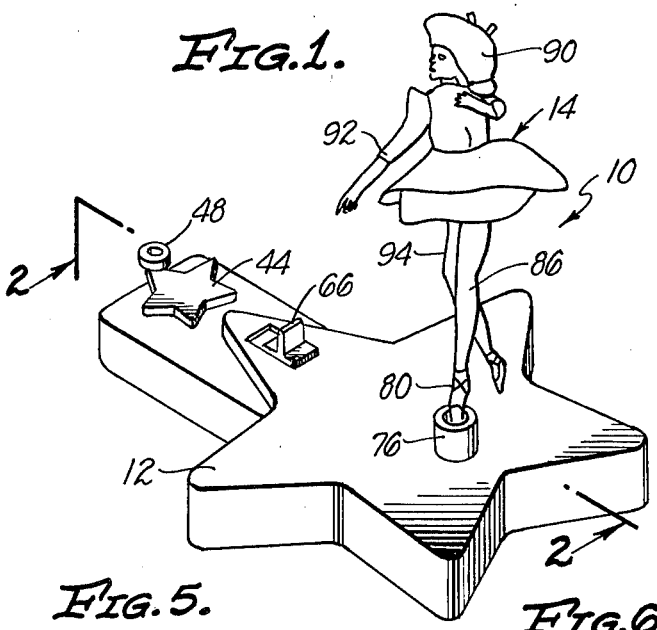
FIG. 1 is an isometric view of a presently preferred embodiment or form of an articulated doll structure of the invention.

Inasmuch as the concepts or principles of the invention defined in the appended claims can be utilized in a number of somewhat differently constructed and somewhat differently appearing doll stuctures through the use or exercise of routine design skill in the toy industry the present invention is not to be considered as limited to a structure which is exactly as shown in the drawings and as described herein.

DETAILED DESCRIPTION OF THE PREFERRED EMBODIMENT

In the drawings there is shown a complete doll structure 10 employing a base 12 which is utilized to support an articulated doll 14. This base 12 is adapted to rest upon an appropriate supporting surface 16 and is provided with a hollow interior 18. An elongated lever 20 is rotatably mounted within the base 12 through the use of trunnious 22. These trunnious 22 fit within appropriate bearing openings 24 located in the interior of the base 12. It will be realized that there are two of these trunions 22 and two of these bearing openings 24 and that these trunions 22 and the openings 24 are located opposite one another.

The lever 20 has an end 26 provided with a guide notch 28 which straddles an alignment web 30 within the interior 18 of the base 12. The lever 20 also includes two spaced parallel projections 32 having what may be referred to as "sloping" or "cam" surfaces 34. These projections 32 are equally spaced from the axis (not shown) of the trunnions 22. These projections 32 are located on opposite sides of an elongated drive shaft 36 which extends along the lever 20. This shaft 36 is retained relative to the lever 20 by means of a "U"-shaped retainer 38 formed on the lever 20 and extending from it around the drive shaft 36.

The base 12 is provided with a bearing opening 40 utilized to carry a shaft 42. The shaft 42 extends downwardly from an attached star-shaped "wheel" 44 located on and against the base 12. This wheel 44 in effect serves as a crank by carrying a pin 46 which carries a small knob 48 in such a manner that the knob 48 may be rotated about the axis of the pin 46. This knob 48 is intended to be utilized in turning the wheel 44 in a crank-type manner so as to rotate a crown gear 50 located on the shaft 42 within the interior 18 of the base 12. Such motion of the gear 50 is transmitted to a spur gear 52 on the shaft 36 and is transmitted by the shaft 36 to another spur gear 54 on this shaft 36. This other spur gear 54 in turn transmits rotation to another crown gear 56 located on a coupling cylinder 58.

This coupling cylinder 58 fits somewhat loosely within an opening 60 in the lever 20 adjacent to the end 26 and also fits through an opening 62 in the base 12. With this structure the coupling cylinder 58 is capable of being linearly moved when a control member 66 is actuated. This member is slidably mounted on the base 12 above an opening 68 leading through this base 12. This control member 66 carries a follower or projection 70 which extends through the opening 68 so as to make contact with the surfaces 34 of the projection 32.

Figure 2:
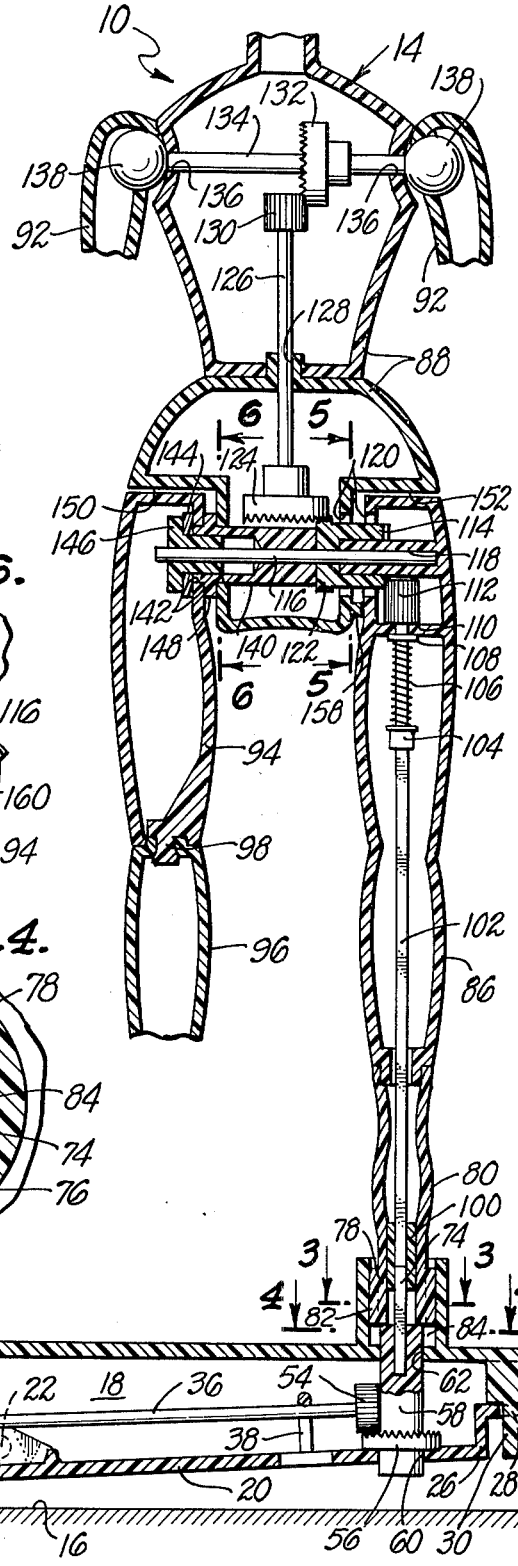
FIG. 2 is a partial cross-sectional view at an enlarged scale taken at line 2—2 of FIG. 1 showing the doll indicated in FIG. 1 with doll clothes removed.
Figure 5:
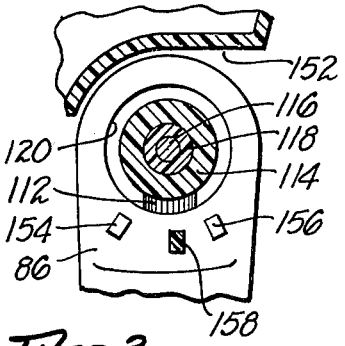
FIGS. 3, 4, 5 and 6 are partial cross-sectional views at an enlarged scale taken at lines 3—3, 4—4, 5—5 and 6—6 of FIG. 2.
Figure 6:
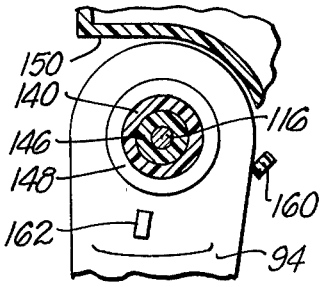
Figure 3:
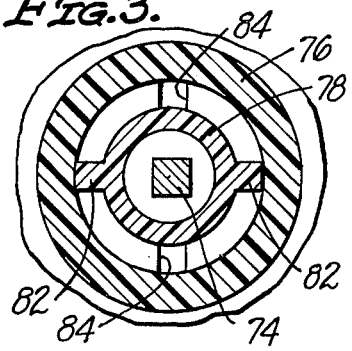
Figure 4:
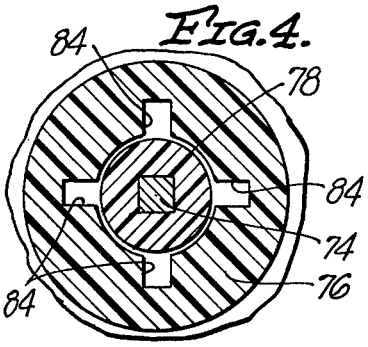

When control member 66 is in a position as shown in FIG. 2 the follower 70 will have pushed against the projections 32 so as to pivot the lever 20 about the trunnions 22 in such a manner as to move the coupling cylinder 58 to its uppermost position. In this uppermost position of the lever 20 the crown gear 56 will exert upward pressure against the spur gear 54. Since the end of the shaft 36 remote from the gear 54 is held by contact of the spur gear 52 with the crown gear 50 and by a shaft support 72 attached to the base 12 engaging the shaft 36 this upward pressure will place the shaft 36 under a limited amount of tension. When this occurs the shaft 36 in effect acts as a spring.

This will tend to "bind up" the described structure in the base 12 in such a manner that the lever 20 is held reasonably firmly in a position as shown in FIG. 2. However, the control member 66 is capable of being moved so as to move the follower 70 along the surfaces 34 of the projections 32 in such a manner that the tension on the drive shaft 36 will be released or slacked off. This and the action of gravity will allow the lever 20 to pivot to a more nearly horizontal position as viewed in FIG. 2. In such a position the coupling cylinder 58 still fits within the opening 62.

This coupling cylinder 58 carries and is secured to a short, non-round shaft 74 in such a manner that this shaft 74 extends upwardly into a cylindrical holder or flange 76 formed on the base 12. This flange 76 is dimensioned so as to be capable of receiving a correspondingly shaped extension 78 on the simulated foot 80 of the doll 14. The extension 78 fits within the flange 76 in such a manner that it is capable of linear movement along the axis (not shown) of the flange 76. In the lowermost position of the extension 78 lugs 82 on the extension 78 fit within notches 84 of a corresponding shape located within the flange 76. It is important that the extension 78 be capable of fitting within the flange 76 as shown in an uppermost position in which the lugs 82 do not fit within the notches 84.

The doll 14 includes a hollow leg 86 extending upwardly from the foot 80. It also includes a hollow simulated body part 88 which carries a simulated head 90, simulated arms 92 and a simulated upper leg part 94 which in turn carries a simulated lower leg part 96. These parts 94 and 96 are assembled together by a conventional type of "loose" interfitting coupling 98 permitting the part 96 to pivot a limited amount forward of and a limited amount backward from the part 94.

Within the leg 86 there is located a socket type coupler 100 which is adapted to fit over and engage the shaft 74 in such a manner as to transmit rotation to a shaft 102 which extends nearly through the length of the leg 86. This shaft 102 carries a small collar 104 which holds a coil spring 106 about the shaft 102 under tension so that this spring 106 biases a washer 108 against a wall 110 located within the leg 86. With this type of structure a friction clutch type action is achieved by virtue of the contact of the washer 108 against the wall 110. This action permits the complete doll 14 to be rotated as a unit when the member 66 is positioned as shown in FIG. 2.

The shaft 102 carries a spur gear 112 which mates with a crown gear 114 mounted on a shaft 116. This shaft 116 is supported in a bearing opening 118 in the leg 86 in such a manner that this shaft 116 is transverse to the shaft 102. The crown gear 114 extends through aligned openings 120 in the leg 86 and in the body part 88. This crown gear 114 carries a spur gear 122 which drives another crown gear 124 so as to rotate a shaft 126 extending through the body part 88. This shaft 126 is held in a bearing opening 128 in the body part 88 and carries a spur gear 130 which mates with a crown gear 132 carried by a cross shaft 134. This shaft 134 is mounted on shoulder openings 136 in the body part 88 and is provided with enlarged, ball-like extremities 138 which are frictionally engaged by the arms 92 in such a manner that these arms 92 will rotate whenever mechanical movement is conveyed to the shaft 134.

The shaft 116 carries a spacer 140 which extends through the body part 88 and through openings 142 located in the body part 88 and in upper leg part 94 which are aligned with the openings 120. A washer 144 is held in frictional contact with the interior (not separately numbered) of the upper leg part 94 by means of an end cap 146 secured to the shaft 116. This structure is used so as to hold the upper leg part 94 against a flange 148 on the spacer 140 which rests against the body part 88. In effect this creates a "sandwich" type of structure serving as a friction clutch permitting gravity to shift the position of the upper leg part 94 within a socket 150 in a body part 88. With this construction the assembly of parts described about the shaft 116 also serves to hold the leg 86 within a corresponding socket 152. These sockets 150 and 152 roughly approximate hip sockets of the human body.

Normally the structure 10 will be stored with the doll 14 separated from the base 12. For the structure 10 to be utilized this doll 14 must be assembled relative to the base 12 by slipping the extension 78 within the flange 76 so that the coupler 100 engages the shaft 74. After such assembly is completed the complete structure 10 may be used by rotating the wheel 44 through the use of the knob 48. The action achieved by such rotation will be dependent upon the position of the control member 66.

If this control member 66 is in a forward position as shown in FIG. 2 in which the coupling cylinder 58 is elevated the action of the doll 14 will resemble that of a ballerina holding a pose and twirling. This is because the lugs 82 will clear the notches 84 and because the washer 108 will be biased sufficiently against the wall 110 so that the rotation transmitted through the coupler 100 will merely result in rotation of the doll 14 about the axis of the flange 76.

At any time the control member 66 may be moved so as to lower the coupling cylinder 58. When this occurs the extension 78 will move within the flange 76 and the lugs 82 will fit within the notches 84. This will have the effect of locking the leg 86 against rotation. When the leg 86 is held in this manner rotation of the knob 48 and of the wheel 44 will be transmitted through various parts as previously indicated to the shaft 102. Because of the slippage between the washer 108 and the wall 110 the doll 14 will not rotate as a unit, but instead the rotation of the shaft 102 will be transferred internally within the doll 14 through various parts as described.

As this occurs the body part 88 will either be tilted forwardly or backwardly depending upon the direction of rotation. Movement of the body part 88 in forward and backward directions will be limited through the use of small stops 154 and 156 on the leg 86 and a stop 158 on the body part 88, respectively. The upper leg part 94 will be caused to move in coordination with the movement of the body part 88 because of the friction clutch type action obtained by the manner of connecting the upper leg part 94 to the body part 88 previously described. Similarly the movement of the upper leg part 94 in a backward direction will be limited by the use of a small stop 160 on the body part 88 hitting against a stop 162 on the upper leg part 94. Concurrently with such movement of the body part 88 motion will be transmitted to the arms 92 so as to cause these arms 92 to rotate with respect to the body part 88.

Figure 7:
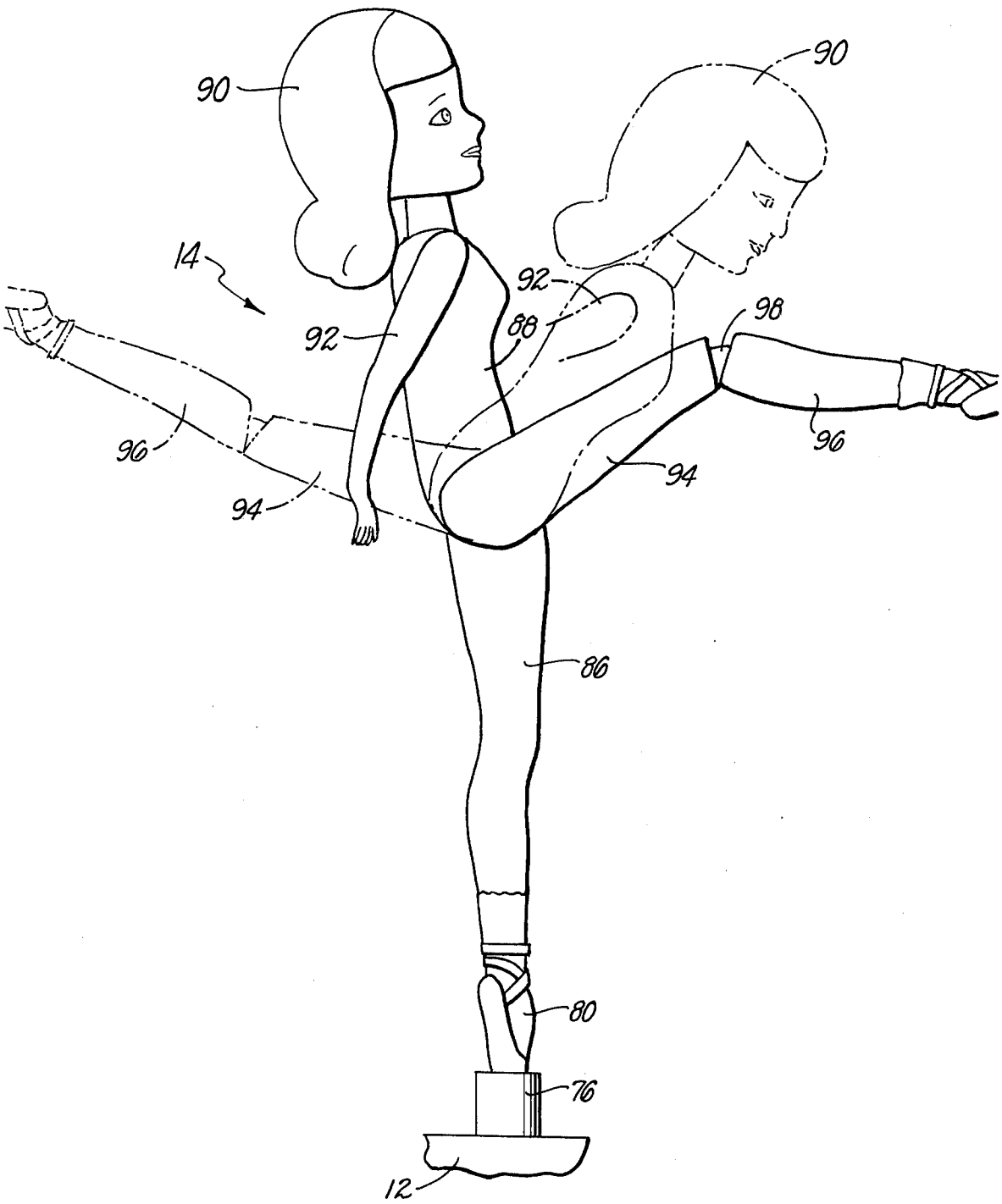
FIG. 7 is a side elevational view of the doll illustrated in the preceding figures illustrating various poses which can be achieved in utilizing the doll structure shown in the preceding figures.

As a result of such movements the doll 14 can be caused to assume any of a wide variety of different configurations or poses as indicated in FIG. 7. Further, the orientation of the various parts of the doll 14 will gradually change during use of the structure 10 as described in what may be described as or considered as a graceful manner. At any time the control member 66 may be moved so as to "freeze" the doll 14 in whatever position it happens to be in when this member 66 is moved. At this point as the knob 48 is actuated the doll 14 will be caused to rotate about a vertically oriented axis in its posed position.

Obviously the structure 10 can be modified in a number of different ways. The extension 78 and the flange or holder 76 may be regarded as cooperating mounting means for holding the leg 86 so that the doll 14 can be rotated about an axis or can be held in a fixed position. It is considered that a wide variety of different mechanical structures can be used for this purpose. Similarly, it is considered that different coupling means can be employed to transfer rotary movement to the doll 14. As an example of this a lose non-round shaft which is physically unattached to either the base 12 or the doll 14 may be used in lieu of the shaft 74.

The number of variations which may be made in the structure 10 without departing from the principles or features of the invention set forth in the claims is considered to be quite large. As a further example of this it is noted that the extension 78 can be rotatably mounted and means can be provided for separately rotating it so that a doll such as the doll 14 can be concurrently rotated and made to assume various different positions. It is considered, however, that the structure 10 described is presently the most desirable, practical structure for use in a toy of the type to which this invention pertains.

I claim:

1. In the combination of a base, a doll which is articulated for relative movement of at least some parts thereof having a leg supported on said base and a rod extending from said base through said leg for use in transmitting motion to at least one relatively movable articulated part of said doll, the improvement which comprises:

said rod being a shaft and being rotatably mounted in said leg, cooperating mounting means on said base and on said leg for holding said leg so that said doll can either be rotated as a unit relative to said base about an axis or so that said leg is held in a fixed position relative to said base, adjustment means for controlling the operation of said mounting means so that said doll can either be given said rotation as a unit about an axis or so that said leg is held in said fixed position, drive means for rotating said shaft located on said base, coupling means for transmitting rotation from said drive means connecting said drive means to said shaft so that during the operation of said drive means said shaft is rotated, and friction clutch means connecting said shaft with said doll for causing enough friction between said shaft and said doll to cause said doll to rotate as a unit when said adjustment means are used to control said mounting means so that said doll can be given said rotation as a unit, said friction clutch means permitting said shaft to transmit motion to said articulated part of said doll when said adjustment means are used to control said mounting means so that said leg is held in a fixed position.

2. The combination claimed in claim 1 wherein:

said cooperating mounting means comprise a holder on said base and an extension on said leg of said doll, said extension fitting within said holder, said cooperating mounting means also including control means for preventing relative movement between said extension and said holder and for permitting relative movement between said extension and said holder in accordance with the operation of said adjustment means.

3. The combination claimed in claim 2 wherein:

said adjustment means comprises means for regulating the position of said extension within said holder.

4. The combination claimed in claim 1 wherein:

said coupling means comprises a coupling member located on said base, a non-round shaft fitting within and extending from said coupling member and a coupler connected to said shaft within said leg, said non-round shaft fitting within said coupler and said coupling member so that when said coupling member is rotated such rotation will be transferred to said shaft.

5. The combination claimed in claim 4 wherein:

said friction clutch means comprises a clutch member carried by said shaft and engaging said leg within the interior of said leg and spring means biasing said clutch member into engagement with said leg.

6. The combination claimed in claim 1 wherein:

said drive means includes a crank capable of being manually turned, gear and shaft means for transmitting motion connecting said crank to said coupling member.

7. The combination claimed in claim 6 wherein:

said adjustment means comprises an elongated lever pivotally mounted within said base, said elongated lever including a cam means for use in controlling the position of said elongated lever and a control member movably mounted on said base, said control member including a follower for engaging said cam means in order to regulate the position of said lever.

8. The combination claimed in claim 1 wherein:

said cooperating mounting means comprise a cylindrical holder on said base and an extension on said leg of said doll, said extension fitting within said holder and being movable in the direction of the axis of said holder, said cooperating mounting means also including interlocking means on said extension and said holder which engage one another in one position of said extension relative to said holder so as to prevent movement of said extension relative to said holder, said coupling means comprises a coupling member located on said base, a non-round shaft fitting within and extending from said coupling member and a coupler connected to said shaft within said leg, said non-round shaft fitting within said coupler and said coupling member so that when said coupling member is rotated such rotation will be transferred to said shaft, said friction clutch means comprises a clutch member carried by said shaft and engaging said leg within the interior of said leg and spring means biasing said clutch member into engagement with said leg, said adjustment means comprises an elongated lever pivotally mounted within said base, said elongated lever including a cam means for use in controlling the position of said elongated lever and a control member movably mounted on said base, said control member including a follower for engaging said cam means in order to regulate the position of said elongated lever, and said drive means includes a crank capable of being manually turned, a mechanical drive train including an elongated shaft for transmitting motion from said crank to said coupling member, said drive train shaft extending along the length of said elongated lever, said drive train shaft being capable of being placed under tension through the use of said control member so as to act as a spring means biasing said cam means against said follower.

9. The combination claimed in claim 8 wherein:

said doll has a body part pivotally mounted on said base-supported leg, a second leg pivotally mounted on said body part and arms pivotally mounted on said body part, mechanical drive means connecting said base-supported leg shaft with said body part and said arms for rotating said body part and said arms as said base-supported leg shaft is rotated, said doll also including means for limiting the rotation of said body part with respect to said base-supported leg and means for limiting rotation of said second leg relative to said body part, and friction means for limiting the movement of said body part relative to said base-supported leg and for limiting movement of said second leg relative to said body part.

* * * * *